US005740644A

United States Patent [19]

Menchetti

[11] Patent Number: 5,740,644

[45] Date of Patent: Apr. 21, 1998

[54] WALL WITH HORIZONTAL METAL STUD AND REINFORCEMENT CHANNEL THEREFOR

[75] Inventor: Robert J. Menchetti, Buffalo, N.Y.

[73] Assignee: National Gypsum Company, Charlotte, N.C.

[21] Appl. No.: 790,682

[22] Filed: Jan. 28, 1997

Related U.S. Application Data

[63] Continuation of Ser. No. 415,547, Apr. 3, 1995, abandoned, which is a continuation-in-part of Ser. No. 385,673, Feb. 8, 1995.

[51] Int. Cl.[6] ..... E04B 2/30

[52] U.S. Cl. ..... 52/281; 52/489.1; 52/731.7; 52/713; 52/729.3

[58] Field of Search ..... 52/281, 282.1, 52/283, 241, 243, 481.1, 489.1, 506.08, 729.3, 731.7, 733.2, 711, 713

[56] References Cited

U.S. PATENT DOCUMENTS

| | | | |
|---|---|---|---|
| Re. 24,658 | 6/1959 | Hollister . | |
| 585,111 | 6/1897 | Lehmann . | |
| 600,392 | 3/1898 | Whitenack | 52/281 |
| 619,968 | 2/1899 | Leonard . | |
| 1,361,831 | 12/1920 | Crew . | |
| 1,545,168 | 7/1925 | Schenck . | |
| 1,598,129 | 8/1926 | Gersman . | |
| 1,662,177 | 3/1928 | Williams . | |
| 1,816,933 | 8/1931 | Robinson et al. . | |
| 1,825,010 | 9/1931 | Murphy . | |
| 2,027,882 | 1/1936 | Ross . | |
| 2,042,290 | 5/1936 | Barrett | 52/481.1 |
| 2,044,637 | 6/1936 | Ross . | |

(List continued on next page.)

FOREIGN PATENT DOCUMENTS

| | | |
|---|---|---|
| 212075 | 3/1946 | Australia . |
| 202688 | 3/1993 | China . |
| 393 000 | 10/1990 | European Pat. Off. . |
| 0 562 779 | 9/1993 | European Pat. Off. . |
| 1095143 | 3/1955 | France . |
| 1432551 | 2/1966 | France . |
| 51685 | 7/1889 | Germany . |
| 5-112992 | 5/1993 | Japan . |
| 7329104 | 11/1984 | Taiwan . |
| 493 129 | 12/1936 | United Kingdom . |

OTHER PUBLICATIONS

Copy of paper titled "USG Cavity Shaft Wall, Area Separation Wall, Furring & Double Wall Components", Part of a publication of Unimast Inc. titled Steel Framing Components And Accessories For Drywall, Plaster And Load Bearing Construction. It contains the date 1992.

Copy of paper titled "Shaftwall/Stairwall Components". Part of a paper titled GYPROC Products and Systems and contains the date 1994.

*Primary Examiner*—Carl D. Friedman
*Assistant Examiner*—Winnie Yip
*Attorney, Agent, or Firm*—Marshall, O'Toole, Gerstein, Murray & Borun

[57] ABSTRACT

This disclosure relates to a reinforced metal stud for use in a hollow wall. The wall includes sheet metal studs placed horizontally between adjacent, horizontally extending gypsum core boards, typically in the walls surrounding an elevator shaft and stairwells, and in area separation walls and the like. The metal studs include an inner flange, an outer flange and an adjoining web connecting the flanges, with a core board abutting each side of the web. Standard or special fire-retardant gypsum wallboards are attached by fasteners to the outer flanges of the metal studs. A hollow space is thus formed between the core boards and the wallboards, the outer flange and a portion of the web being within the hollow space. A reinforcement channel is provided for attachment to and strengthening of the stud. The web and the outer flange of the stud form a partially enclosed space, and the reinforcement channel nests in the enclosed space. Fasteners secure the channel to the web of the stud, and additional fasteners may secure the wallboard to the outer flange of the stud and to the channel.

9 Claims, 2 Drawing Sheets

U.S. PATENT DOCUMENTS 2,047,835 7/1936 Prew .
2,049,278 7/1936 Toussaint et al. .
2,065,493 12/1936 Greulich .
2,076,472 4/1937 London .
2,078,620 4/1937 Venzie .
2,092,210 9/1937 Greulich .
2,157,233 5/1939 Geib, Jr. ..... 52/731.7
2,185,904 1/1940 Stowe .
2,271,472 1/1942 Balduf .
2,307,898 1/1943 Olsen .
2,316,668 4/1943 Bronner .
2,351,525 6/1944 Leary .
2,372,038 3/1945 Westveer .
2,495,862 1/1950 Osborn .
2,554,418 5/1951 Mortenson ..... 52/781
2,605,867 8/1952 Goodwin .
2,638,637 5/1953 Kump, Jr. .
2,663,181 12/1953 Collman .
2,752,013 6/1956 Cole .
2,976,971 3/1961 Lundberg .
3,013,644 12/1961 Smith et al. .
3,065,575 11/1962 Ray .
3,090,164 5/1963 Nelsson .
3,101,817 8/1963 Radek ..... 52/241
3,176,432 4/1965 Doolittle, Jr. .
3,225,503 12/1965 Rallis .
3,235,039 2/1966 O'Donnell .
3,242,627 3/1966 Fountain .
3,251,164 5/1966 Wright .
3,266,209 8/1966 Zibell .
3,271,920 9/1966 Downing, Jr. .
3,274,739 9/1966 Gregoire .
3,287,041 11/1966 Choen .
3,294,353 12/1966 Rowe .
3,312,032 4/1967 Ames .
3,349,535 10/1967 Balinski .
3,362,056 1/1968 Preller et al. .
3,381,439 5/1968 Thulin, Jr. .
3,397,500 8/1968 Watson, Jr. .
3,418,776 12/1968 Manderbach et al. .
3,428,326 2/1969 Clapsaddle ..... 52/773
3,477,184 11/1969 Johnson et al. .
3,485,001 12/1969 Miller .
3,495,417 2/1970 Ratliff, Jr. .
3,508,364 4/1970 Thompson ..... 52/479
3,517,474 6/1970 Lanternier .
3,603,054 9/1971 Didry .
3,651,610 3/1972 Donahue .
3,702,044 11/1972 Balinski .
3,705,002 12/1972 Varlonga .
3,740,912 6/1973 Sauer et al. ..... 52/483.1
3,765,138 10/1973 Bentle .
3,839,839 10/1974 Tillisch et al. .
3,845,594 11/1974 Butts et al. .
3,845,601 11/1974 Kostecky .
3,866,376 2/1975 Nelsson .
3,881,293 5/1975 Conville .
3,921,346 11/1975 Sauer et al. ..... 52/481.1
3,940,899 3/1976 Balinski .
3,950,900 4/1976 Simpson ..... 52/773 X
3,974,608 8/1976 Grearson .
4,002,261 1/1977 Litchfield .
4,011,704 3/1977 O'Konski .
4,024,691 5/1977 Hansen et al. .
4,047,347 9/1977 Scheid .
4,047,354 9/1977 Sutherland .
4,047,355 9/1977 Knorr ..... 52/481.1
4,074,486 2/1978 Grearson .
4,109,440 8/1978 Bill ..... 52/721
4,125,984 11/1978 Jonas .
4,129,970 12/1978 Whitney .
4,147,379 4/1979 Winslow .
4,187,653 2/1980 Kliewer, Jr. .
4,201,020 5/1980 Saunders .
4,240,234 12/1980 Eisinger et al. .
4,251,973 2/1981 Paik .
4,353,192 10/1982 Pearson et al. .
4,364,212 12/1982 Pearson et al. .
4,435,936 3/1984 Rutkowski ..... 52/481.1
4,443,991 4/1984 Mieyal .
4,587,783 5/1986 McCoy et al. .
4,597,278 7/1986 Hamada et al. .
4,640,076 2/1987 Migliore .
4,852,325 8/1989 Dunn et al. .
4,866,899 9/1989 Houser .
4,893,446 1/1990 Gudmundsson et al. ..... 52/241
4,897,976 2/1990 Williams et al. .
4,905,428 3/1990 Sykes .
4,909,006 3/1990 Hickman et al. .
4,914,880 4/1990 Albertini .
4,918,879 4/1990 Bodurow et al. .
4,969,304 11/1990 Helderman .
4,982,540 1/1991 Thompson .
5,065,559 11/1991 Zegel et al. .
5,090,174 2/1992 Fragale .
5,092,100 3/1992 Lambert et al. ..... 52/481.1 X
5,094,052 3/1992 Gudmundsson et al. .
5,129,628 7/1992 Vesper .
5,263,295 11/1993 Laird et al. .

FIG. 3
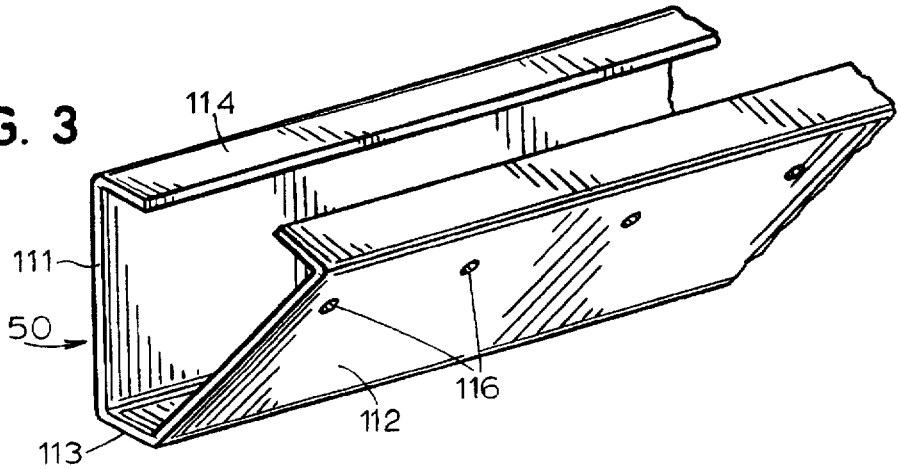
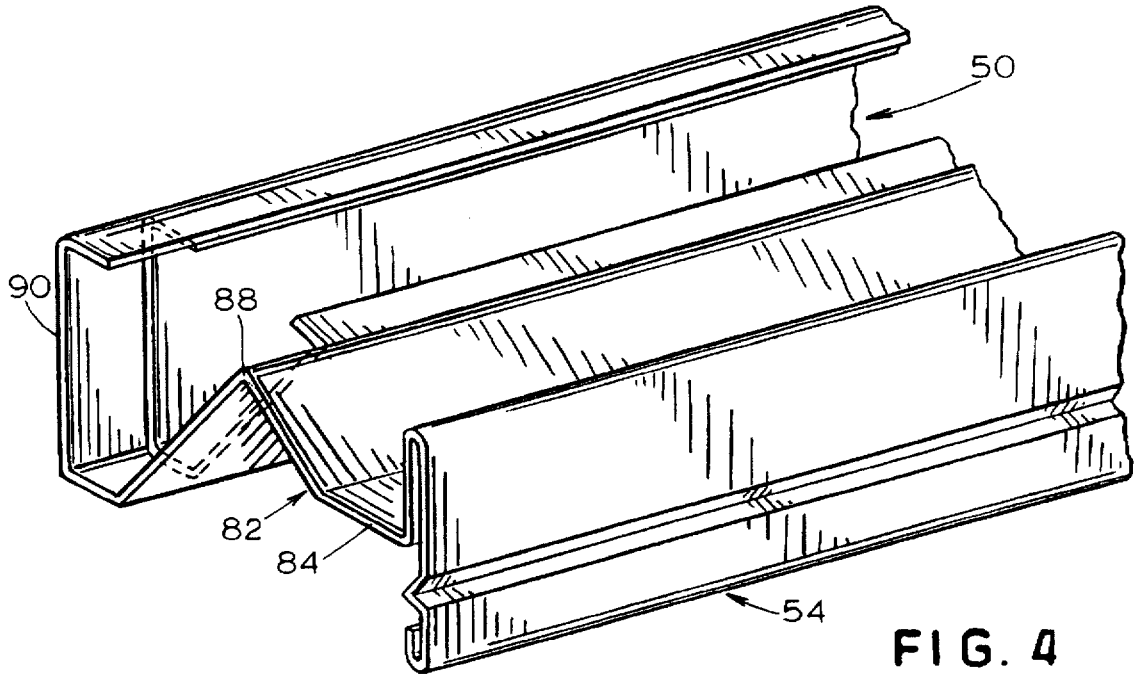
FIG. 4
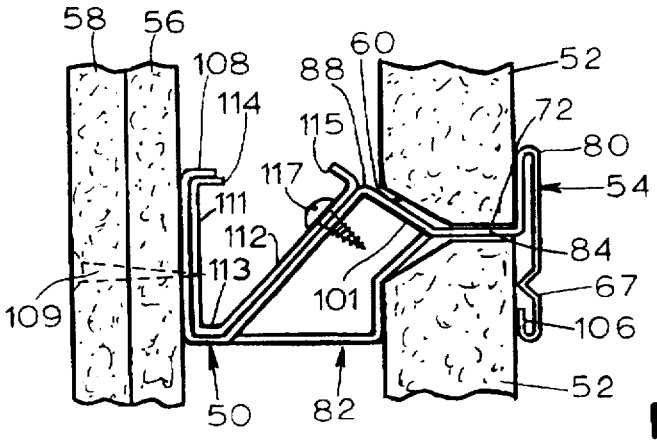
FIG. 5

WALL WITH HORIZONTAL METAL STUD AND REINFORCEMENT CHANNEL THEREFOR

This application is a continuation of U.S. application Ser. No. 08/415,547, filed Apr. 3, 1995, now abandoned, which is a continuation-in-part of pending application Ser. No. 08/385,673, filed Feb. 8, 1995.

FIELD AND BACKGROUND OF THE

This invention relates to a hollow wall with horizontal sheet metal studs and to reinforcement channels for the studs.

Several patents, such as U.S. Pat. Nos. 3,740,912 and 4,353,192, have disclosed hollow shaft walls employing metal studs and gypsum wallboards. By a hollow shaft wall, it is meant a wall around an elevator shaft of a multiple-story building; the wall being hollow and having fire resistance qualities. These prior patents all describe the use of sheet metal studs between adjacent gypsum core boards, the metal studs being arranged vertically. These prior structures have enjoyed considerable commercial success.

An improved shaft wall which is more easily installed at lower cost and with improved fire resistance performance has also been proposed. The proposed wall includes horizontally extending studs and spaced apart parallel sheets or panels of gypsum wallboard or core board. The boards of one of the two sheets are horizontally elongated and are vertically stacked. The studs are interposed between and attached to adjacent horizontally elongated boards, and the studs are also attached to the boards of the other sheet. Thus the horizontal studs serve to support the parallel sheets and hold them in vertical parallel planes.

While the above proposed wall functions well, there is a need for use of the wall to enclose long horizontal spans. For example, a modern high rise building may have a number of side-by-side elevators, creating a need for a shaft wall having a long horizontal span.

An extra long span places an increased load on the horizontal studs. The studs are normally made of sheet steel which is cut and roll formed to the final shape. To meet an increased load, the gauge (thickness), of the sheet metal could be increased or the size of the stud could be increased, but this approach would have the disadvantage that the overall depth of the finished wall may be increased. Further, this approach would likely require the manufacture and stocking of two or more stud designs, one for short and average length spans and another for long length spans.

While the description and the drawings herein refer to a wall around an elevator shaft, the wall also has uses elsewhere such as around stairwells or as an area separation wall between adjoining condominiums and townhouses.

It is a general object of this invention to provide an improved reinforcement channel for a stud, to a stud including such a reinforcement channel, and to a wall including horizontal studs with reinforcement channels.

SUMMARY OF THE INVENTION

In a wall including apparatus according to the present invention, sheet metal studs are placed horizontally between adjacent, horizontally extending gypsum core boards, typically in the vertical walls surrounding an elevator shaft and stairwells, and in area separation walls and the like. The metal studs include, essentially, an inner flange, an outer flange and an adjoining web connecting the flanges, with a core board abutting each side of the web adjacent the inner flange. A standard or special fire-retardant gypsum wallboard (referred to as wide wallboard) is attached by fasteners to the outer flanges of the metal studs.

A secondary reinforcement channel is provided for attachment to and strengthening of at least one stud. The web and the outer flange of the stud form a partially enclosed space, and the reinforcement channel nests in the enclosed space. Fasteners secure the channel to the web of the stud, and additional fasteners may secure the channel to the outer flange of the stud and to the wallboard.

BRIEF DESCRIPTION OF THE DRAWINGS

These and other objects and advantages of the invention will be more readily apparent when considered in relation to the preferred embodiments as set forth in the specification and shown in the drawings in which

FIG. 3 is a perspective view of a reinforcement channel for a stud;

FIG. 4 is a perspective view of the reinforcement channel combined with the stud; and FIG. 5 is a sectional view taken on the line 5—5 of FIG. 1.

DESCRIPTION OF THE PREFERRED EMBODIMENTS

Figure 1:
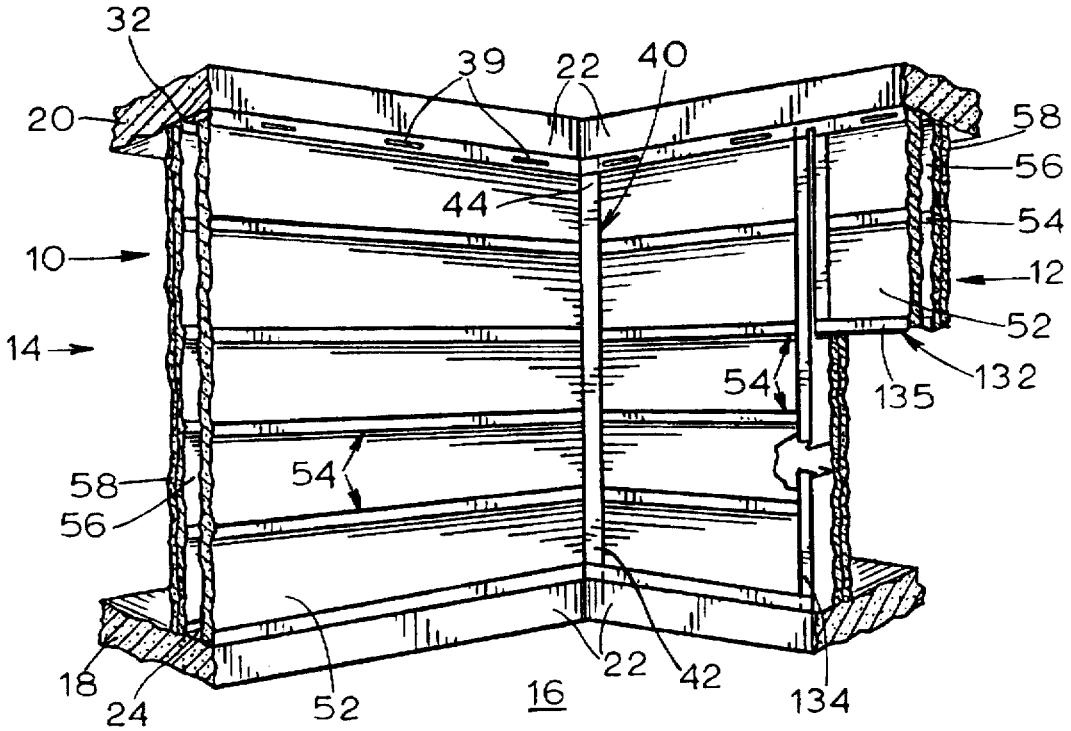
FIG. 1 is a perspective view of a portion of two perpendicular walls forming an elevator shaft enclosure, constructed in accordance with the invention.

Portions of the wall shown in FIG. 1 are the same as the wall described in pending U.S. application Ser. No. 08/385,673 filed Feb. 8, 1995, and the disclosure of application Ser. No. 08/385,673 is incorporated herein by reference.

Referring to FIG. 1, there is shown part of a side wall 10 and part of a front wall 12 of a hollow shaft wall structure 14 surrounding an elevator shaft 16. The elevator shaft 16 extends vertically through a number of floors of floor-ceiling platforms, including a lower or floor platform 18 and the upper or ceiling platform 20 as shown in FIG. 1. The shaft wall structure 14 extends vertically from the lower platform 18 to the upper platform 20 along the edges 22 of these floor-ceiling platforms, the edges 22 and the wall structure 14 thus surrounding and forming the elevator shaft 16.

The side wall 10 comprises a standard upwardly opening, channel-shaped floor track 24 in the shape of a U or J channel having a horizontal web and two vertical flanges. A similar downwardly opening ceiling track 32 having a horizontal web and two vertical flanges is also provided. Floor track 24 is mechanically affixed to the top surface of lower platform 18 and the ceiling track 32 is mechanically affixed to the bottom of upper platform 20, each adjacent the edges 22 of these floor-ceiling platforms. Ceiling track 32 preferably has a plurality of spaced-apart vent openings 39 to improve the wall fire-resistance.

At the corner of the side wall 10 and the front wall 12, as seen in FIG. 1, a vertical corner post 40 is mounted with a bottom end 42 disposed in and secured to the floor track 24 and a top end 44 disposed in and secured to the ceiling track 32, where the two floor tracks 24 and the two ceiling tracks 32 meet to form a 90° corner between side wall 10 and front wall 12. The corner post 40, which could be made by affixing two channels together back-to-side, may be a single, elongate, roll-formed sheet of metal having two outwardly opening channels formed of a single piece of 0.020-inch-thick sheet steel, with the two channels opening outwardly in directions at a 90° angle to one another and being directed toward the side wall 10 and the front wall 12.

In a modified wall, corner clips (not illustrated) may replace the corner post 40.

Considering the structure of the side wall 10, FIGS. 1 and 5 show the arrangement of vertically aligned core boards 52, horizontal studs 54, and outwardly disposed gypsum wide wallboards 56 and 58, which combine, along with a reinforcement channel 50 shown in FIGS. 3 to 5, to form the side wall 10.

Typically the core boards 52 are paper-covered gypsum boards which are, in cross section, two feet wide by one inch thick, and have a relatively long horizontal length. The boards 52 may have bevelled edges 60 along the two long edges of each core board 52 as shown in FIG. 5, but non-bevelled board can be used. Preferably, the bevelled edges 60 have a flat portion 72, of a width of about ⅜ inch, but this could be varied considerably.

After the floor track and the ceiling track are in place, the first or lowest core board 52 to be installed in constructing the wall 10 has a flat bottom edge resting on the web of floor track 24, and its face is held against an interior flange of the floor track by a plurality of screws. At least one end of the core board 52 extends into the corner post 40. On top of the first or bottom most core board 52 to be installed is the lowest or first horizontal stud 54, and progressively, in constructing the wall 10, additional core boards 52 and horizontal studs 54 alternately are put into place. After the core boards 52 and the horizontal studs 54 are assembled, two layers of gypsum wide wallboard 56 and 58, such as four foot wide and ½-inch or ⅝-inch thick, are attached by screws 109 (FIG. 5) to an outer flange of each horizontal stud 54 and to the corner post 40.

Referring to the front wall 12 shown in FIG. 1, an elevator doorway 132 is shown, formed by two vertical roll-formed, sheet metal elongate door-frame posts 134 (one vertical post not shown). As shown in a broken-away portion in FIG. 1, the door frame posts 134 include a web, two perpendicular flanges and an inwardly protruding lip. A short section of regular formed sheet metal elongate channel 135 is affixed back-to-back with the portion of vertical door frame post 134 extending from the top of doorway 132 to the ceiling track 32, and the section of channel 135 extends across the top of doorway 132.

Front wall 12 has short sections of core board 52 alternating with short sections of horizontal stud 54 along the side of doorway 132, with boards 52 and studs 54 extending into the channel of corner post 40 and into the door frame post 134. Other short sections of horizontal studs 54 and core boards 52 extend horizontally over doorway 132 and into the short sections of channel 135. Two layers of gypsum wide wallboard 56 and 58 are screw attached to the outer flanges of horizontal studs 54 and to posts 40 and 134.

Figure 2:
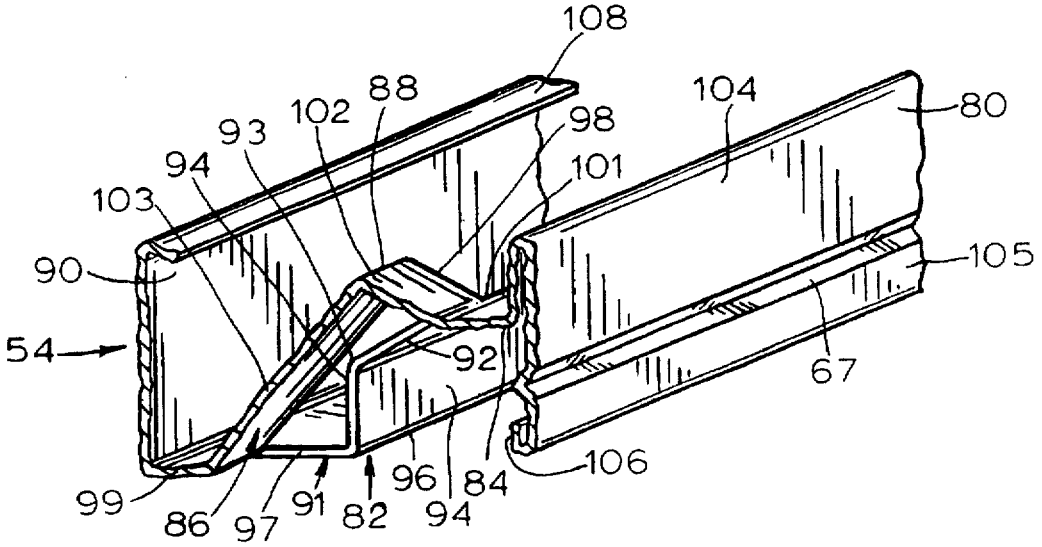
FIG. 2 is an enlarged fragmentary view in perspective of a stud of the walls shown in FIG. 1.

FIGS. 2 and 4 show the stud 54 in greater detail, and FIG. 5 shows the horizontal stud 54 along with two core boards 52 and wallboards 56 and 58. Horizontal stud 54 is an elongate roll-formed sheet of metal having a thickness of, for example, about 0.020 inch thick steel. It has a cross section which includes an inner flange 80, a web 82 extending perpendicularly outwardly from the middle of inner flange 80 about ⅝ inch forming a flat portion 84, whereat a major portion 86 of web 82 extends upwardly and outwardly about ⅝ inch to bend 88 and thence downwardly and outwardly to a short web part 99 and to an upwardly extending outer flange 90. A minor portion 91 of the web 82, about, for example, a 3-inch longitudinal length of each foot of the web extends in portion 92 downwardly and outwardly about ⅝ inch to bend 93, thence downwardly in portion 94 to bend 96 and thence outwardly in web part 99. The web part 99 extends a short distance perpendicularly of the outer flange 90. Slits 98 cut crosswise of web 82 during forming of the horizontal stud 54, from the flat portion 84 to the web part 99 enable the minor portion 91 no be bent from the major portion 86. The slits 98 are preferably angled slightly to form minor portions 91 which have a shorter dimension along the part 99 than along the bend 101, whereat the minor portion 91 is adjoined to the flat portion 84. By angling the slits 98, heat transfer through the stud, from one flange to the opposite flange is reduced, and, also, the studs are more easily stacked for warehousing and shipping.

The bend 88 divides the major portion 86 of web 82 into a ramp portion 102 and a connecting diagonal portion 103. The bends 93 and 96 divide the minor portion 91 into a bevel portion 92, a board holding portion 94 and a connecting portion 97.

Both ends of web major portion 86 and of web minor portion 91 are integrally connected to the other parts of the stud; in other words, they have no free or dangling ends. Thus, as shown in FIG. 2, web 82 has no tabs or any other part with a dangling or free end, all of which enhances the structural integrity of the web.

Inner flange 80 includes an upper folded or double-thickness portion 104 and a lower single-thickness portion 105 which includes a lower hem 106 and a midway rib 67, both extending outwardly. The upper edge of the outer flange 90 is bent inwardly toward the inner flange 80, thereby forming a leg 108.

As previously mentioned, horizontal stud 54 is mounted atop an upper edge portion of one of the two core boards 52 (see FIG. 5) and a lower edge portion of the next higher core board 52 is disposed atop stud 54. The upper edge portion of the lower core board 54 is held firmly between board holding portion 94 of web minor portion 91 and the hem 106 and rib 107 of the inner flange 80. The upper edge of the core board has a flat top portion 72 and a bevelled portion 60 with an elongate corner therebetween of about 150°. Flat portion 72 abuts flat portion 84 of web 82. Bevelled portion 60 is parallel to and closely spaced from slanted portion 92.

The lower edge portion of the upper core board 52 also has the flat bottom portion 70 and the bevelled portion 60. Flat bottom portion 70 is closely adjacent the flat portion 84 of web 82, and the junction of the flat bottom portion 70 and the bevelled portion 60 rests on ramp portion 102.

Depending upon the length of the span of the wall 10, a reinforcement channel 50 may be secured to some or all of the studs 54 as shown in FIGS. 4 and 5 in order to reinforce, or add structural strength to, the studs. For the wall 12 which has a relatively short span, studs 54 alone (with reinforcement channels) may be used. For the wall 10 having a relatively long spans the same studs 54 but with reinforcement channels 50 attached thereto are used. The portion of the stud 54 including the leg 108, the outer flange 90, the part 99, and the diagonal section 103 forms a partially enclosed space or charper 110, and the channel 50 nests in this space. The channel 50 (FIG. 3) includes two elongated flat flanges 111 and 112 connected by a narrow web 113. The parts 111, 112 and 113 are sized and angled similarly to the parts 90, 99 and 103 such that the channel 50 nests or fits snugly against the interior surfaces of the stud parts 90, 99 and 103, as shown in FIG. 5. Further, the upper edge of the outer flange 111 includes a leg 114 which extends at substantially a right angle to the flange 111 and fits under the leg 108. The upper edge of the slanted flange 112 preferably has an upwardly and outwardly turned lip 115 formed on it, the leg 114 and the lip 115 serving to stiffen the longitudinal edge portions of the flanges 111 and 112. The part 99 of the stud forms a narrow flat shelf which is engaged by the web 113 of the channel 50.

The channel 50 is preferably roll formed from a sheet of steel having a thickness equal to or greater than that of the stud 54. The length (the vertical height) of the flange 111 is less than that of the flange 90 by slightly more than twice the thickness of the stud metal. Similarly, the width of the web 113 is less than that of the shelf-like part 99 by slightly more than twice the thickness of the stud metal. As a results the channel may be assembled with the stud by hooking the leg 114 under the leg 108 and then flexing the sheet metal parts sufficiently to snap the channel into the space 110 as shown in FIGS. 4 and 5.

As best illustrated in FIGS 5, the web 112 of the channel 50 substantially overlies and covers the web part 103 of the stud 54. Adjacent the lip 115, a plurality of holes 116 are preferably formed through the web 112, and screw fasteners 117 (FIG. 5) are provided to tightly secure the web 112 to the web part 108, thus further rigidifying the assembly. Further, the screw fasteners 109 extend through the wallboard 56 and 58 and through the two flanges 90 and 111 and strengthen the assembly.

As illustrated in FIG. 5, the holes 116 are sufficiently far up on the flange 112, relative to the height of the flange 90, that a screw driver can extend over the leg 108 and engage the screws 117.

It will be apparent from the foregoing that a novel and useful structure has been provided. The studs 54 may be used in both relatively short and long wall spans so that only a single standard stud gauge and size needs to be manufactured and stocked. In instances where greater structural strength is desired, whether for a long wall span or for any other reason, a reinforcement channel 50 may be secured to a standard stud to attain the desired structural strength.

What is claimed is:

1. A reinforced elongated metal stud comprising, in cross section, inner and outer flanges, each of said flanges having upper and lower edges and said flanges being substantially parallel and spaced apart; a web extending between and integrally formed with said flanges; said web including a diagonal portion connected to said lower edge of said outer flange and extending at an angle upwardly and toward said inner flange; said outer flange including a stud leg formed on said upper edge thereof and extending toward said inner flange; said outer flange, said diagonal portion and said stud leg forming a partially enclosed space; and a reinforcement channel positioned within said partially enclosed space, said channel comprising a vertical flange engaging said outer flange, a slanted flange engaging said diagonal portion, and a channel leg engaging said stud leg, said vertical flange, said slanted flange and said channel leg fitting snugly against said outer flange, said diagonal portion and said stud leg, respectively.

2. A reinforced elongated metal stud as set forth in claim 1, wherein said stud further comprises a web part between and connecting said outer flange and said diagonal portion, said web part extending substantially laterally of said outer flange, and said channel further comprising a channel web connecting said vertical and slanted flanges and fitting snugly against said web part.

3. A reinforced elongated metal stud as set forth in claim 1, and further comprising fastening means for securing said slanted flange to said diagonal portion.

4. A reinforced elongated metal stud as set forth in claim 1, wherein said slanted flange of said channel includes an inner edge, and said channel further comprises a lip formed on said inner edge of said slanted flange, said lip extending generally in the direction of said vertical flange.

5. A hollow wall extending vertically upwardly from a floor, comprising:

(a) at least one horizontally disposed, elongate, formed sheet metal stud, said stud being formed from a single sheet of sheet metal and having an inner flange, a central web and an outer flange;

(b) a plurality of core boards, each of said boards having an upper edge and a lower edge, said lower edge of at least one of said core boards being immediately above said stud and supported on said central web of said stud, and said upper edge of a second of said core boards being immediately below said stud and disposed against and supporting said central web of said stud, means on said stud holding said core board edges spaced inwardly from said outer flange of said stud thereby forming a hollow space between said outer flange and said core boards;

(c) wallboard affixed to an outer face of said outer flange of said horizontal stud; and (d) a reinforcement channel positioned in said hollow space and fastened to said horizontal stud, said channel engaging said outer flange and a portion of said central web, said central web including a diagonal portion extending upwardly and toward said inner flange from said outer flange, and said channel including a slanted portion which is substantially flat against said diagonal portion, and means for securing said slanted portion to said diagonal portion.

6. A hollow wall extending vertically upwardly from a floor, comprising:

(a) at least one horizontally disposed, elongate, formed sheet metal stud, said stud being formed from a single sheet of sheet metal and having an inner flange, a central web and an outer flange;

(b) a plurality of core boards, each of said boards having an upper edge and a lower edge, said lower edge of at least one of said core boards being immediately above said stud and supported on said central web of said stud, and said upper edge of a second of said core boards being immediately below said stud and disposed against and supporting said central web of said stud, means on said stud holding said core board edges spaced inwardly from said outer flange of said stud thereby forming a hollow space between said outer flange and said core boards;

(c) wallboard affixed to an outer face of said outer flange of said horizontal stud; and (d) a reinforcement channel positioned in said hollow space and fastened to said horizontal stud, said channel engaging said outer flange and a portion of said central web, said outer flange including a leg on an upper edge thereof, said leg extending generally toward said inner flange, and said channel including a portion engaging under said leg.

7. A channel for reinforcing a horizontal stud of a hollow wall, said channel comprising, in cross section, an outer flange having upper and lower edges, a height and a length, a leg formed along said upper edge and a narrow web formed along said lower edge, said web having a width, said width of said web being smaller than said height of said outer flange, said leg and said web extending substantially perpendicularly from said outer flange and in the same direction from said outer flange, and a slanted flange connected to and extending upwardly and at an angle from said web, said length and said width being selected to provide a snap fit of the channel within a horizontal stud, said outer flange, said leg, said web, and said slanted flange defining a partially enclosed space having an opening, said opening providing an access for a pushing force to abut said channel against the stud such that said outer flange is disposed substantially vertically against the stud, said leg is disposed substantially horizontally against the stud and said slanted flange is disposed against a diagonal flange of the stud.

8. A channel as set forth in claim 7, and further comprising a lip formed on said slanted flange, said lip extending generally toward said outer flange.

9. A channel for reinforcing a horizontal stud of a hollow wall, said channel comprising, in cross section, an outer flange having upper and lower edges and a height, a leg formed along said upper edge and a narrow web formed along said lower edge having a width, the width of the web being smaller than the height of the outer flange, said leg and said web extending substantially perpendicularly from said outer flange and in the same direction from said outer flange, and a slanted flange connected to and extending upwardly and at an angle from said web, each of said outer flange, said leg and said slanted flange having a flat outer surface for contacting flat surfaces of a stud, said outer flange, said leg, said web, and said slanted flange defining a partially enclosed space having an opening, said opening providing an access for a pushing force to abut said channel against the stud such that said outer flange is disposed substantially vertically against the stud, said leg is disposed substantially horizontally against the stud and said slanted flange is disposed against a diagonal flange of the stud.

* * * * *